US010544782B2

(12) United States Patent
Kobayashi et al.

(10) Patent No.: US 10,544,782 B2
(45) Date of Patent: Jan. 28, 2020

(54) HERMETIC COMPRESSOR AND REFRIGERATION DEVICE

(71) Applicant: PANASONIC APPLIANCES REFRIGERATION DEVICES SINGAPORE, Singapore (SG)

(72) Inventors: Masanori Kobayashi, Shiga (JP); Kazuhiro Yokota, Shiga (JP); Terumasa Ide, Kyoto (JP); Kenji Kinjo, Shiga (JP)

(73) Assignee: PANASONIC APPLIANCES REFRIGERATION DEVICES SINGAPORE, Signapore (SG)

( * ) Notice: Subject to any disclaimer, the term of this patent is extended or adjusted under 35 U.S.C. 154(b) by 154 days.

(21) Appl. No.: 15/328,359

(22) PCT Filed: Sep. 18, 2015

(86) PCT No.: PCT/JP2015/004795
§ 371 (c)(1),
(2) Date: Jan. 23, 2017

(87) PCT Pub. No.: WO2016/051723
PCT Pub. Date: Apr. 7, 2016

(65) Prior Publication Data

US 2017/0211563 A1 Jul. 27, 2017

(30) Foreign Application Priority Data

Sep. 30, 2014 (JP) ..... 2014-200320
Aug. 24, 2015 (JP) ..... 2015-164408

(51) Int. Cl.
*F04B 39/00* (2006.01)
*F25B 31/02* (2006.01)
(Continued)

(52) U.S. Cl.
CPC ..... *F04B 39/0044* (2013.01); *F04B 35/04* (2013.01); *F04B 39/02* (2013.01);
(Continued)

(58) Field of Classification Search
CPC .. F04B 39/0044; F04B 39/02; F04B 39/0027; F04B 39/023; F04B 39/121; F25B 2500/12; F25B 2500/13
(Continued)

(56) References Cited

U.S. PATENT DOCUMENTS 6,435,841 B1 * 8/2002 Kim ..... F04B 39/0033 417/312
2006/0292023 A1 * 12/2006 Kim ..... F04B 39/0027 417/572
(Continued)

FOREIGN PATENT DOCUMENTS

CN 1884829 A 12/2016
JP 2-159440 6/1990
(Continued)

OTHER PUBLICATIONS

Kita, Ichiro, JP 2000249061 A, Compressor, Sep. 2000, European Patent Office, English Translation.*
(Continued)

*Primary Examiner* — Frantz F Jules
*Assistant Examiner* — Steve S Tanenbaum
(74) *Attorney, Agent, or Firm* — Hamre, Schumann, Mueller & Larson, P.C.

(57) ABSTRACT

A hermetic compressor includes, inside hermetic container (1), electric motor element (2), compression element (3) driven by electric motor element (2), and lubricating oil (7) for lubricating compression element (3). The hermetic compressor further includes vibration damping member (16) having one part fixed to hermetic container (1) and another
(Continued)

part being free end part (18). Structurally, a natural frequency of vibration damping member (16) is in substantial conformity with a natural frequency of hermetic container (1).

12 Claims, 14 Drawing Sheets

(51) Int. Cl.

| | |
|---|---|
| ***F25B 1/02*** | (2006.01) |
| ***F04B 49/20*** | (2006.01) |
| ***F04B 39/02*** | (2006.01) |
| ***F04B 35/04*** | (2006.01) |
| ***F04B 39/12*** | (2006.01) |

(52) U.S. Cl.
CPC ..... *F04B 49/20* (2013.01); *F25B 1/02* (2013.01); *F25B 31/023* (2013.01); *F25B 2500/12* (2013.01); *F25B 2500/13* (2013.01)

(58) Field of Classification Search
USPC ..... 62/296
See application file for complete search history.

(56) References Cited

U.S. PATENT DOCUMENTS

2008/0253909 A1* 10/2008 Kawabata ..... C09K 5/042 417/367
2014/0099218 A1* 4/2014 Hiwata ..... F04C 29/12 417/410.3

FOREIGN PATENT DOCUMENTS

| | | | | |
|---|---|---|---|---|
| JP | 10-205447 | | | 8/1998 |
| JP | H1169473 | | | 3/1999 |
| JP | 2000-240718 | | | 9/2000 |
| JP | 2000249061 | A | * | 9/2000 |
| JP | 2000249061 | A | * | 9/2000 |
| JP | 2002-303282 | | | 10/2002 |
| JP | 2007-002847 | | | 1/2007 |
| JP | 2009008171 | A | | 1/2009 |
| KR | 20050031778 | A | | 4/2005 |

OTHER PUBLICATIONS

Kita, Ichiro, JP 2000249061 A, Compressor, Sep. 2000, European Patent Office, English Translation (Year: 2000).*
International Search Report of PCT application No. PCT/JP2015/004795 dated Dec. 15, 2015.
Extended European Search Report issued for corresponding European Patent Application No. 15845801.8, dated Sep. 21, 2017, 7 pages.
Office Action issued for Japanese Patent Application No. 2016-551520, dated Nov. 1, 2019, 9 pages including English machine translation.

* cited by examiner

HERMETIC COMPRESSOR AND REFRIGERATION DEVICE

TECHNICAL FIELD

The present invention relates to a hermetic compressor and a refrigeration device using the same, such as a refrigerator or a showcase. The present invention more particularly relates to a noise control structure of the hermetic compressor.

BACKGROUND ART

A hermetic compressor is generally formed to have, for example, a compression mechanism of a reciprocating type, a rotary type or a scroll type inside a hermetic container. The compression mechanism sucks in, compresses and discharges a refrigerant. The suction, compression and discharge of the refrigerant cause pulsation, so that vibration having a low frequency of 50/60 Hz attributed to operating rotational speed and noise are transmitted via the refrigerant and lubricating oil inside the hermetic container. At the same time, harsh harmonic noise in a human audible range, such as suction/discharge valve tapping noise of the compression mechanism, is transmitted to the hermetic container through a solid contact portion for excitation, thereby producing noise.

In particular, the hermetic compressor of the reciprocating type has the compression mechanism suspended inside the hermetic container by suspension springs, and the hermetic container has a large inside diameter. Thus, the hermetic container has low rigidity and also has a low natural frequency. For this reason, the harmonic noise in a range of about 2 kHz to 8 kHz, such as the valve tapping noise produced from the compression mechanism of the hermetic compressor, overlaps readily with the natural frequency of the hermetic container that is determined by, for example, a shape, a plate thickness or material of the hermetic container. Consequently, noise levels particularly tend to increase in the above frequency band.

The hermetic compressor of the rotary type or the like has a noise problem associated with a fundamental wave having 50 Hz/60 Hz pressure pulsation. On the other hand, the hermetic compressor of the reciprocating type problematically produces harmonic noise in a band of resonance frequencies (2 kHz to 8 kHz) that is attributed to the natural frequency of the hermetic container, and the resonance frequencies in this band are higher by an order of magnitude or more than the frequency of the problematic noise of the hermetic compressor of the rotary type or the like. This problem is peculiar to the reciprocating type.

As such, conventional hermetic compressors of various types have various noise control measures. One of those measures uses a dynamic vibration absorbing effect (refer to, for example, PTL 1).

FIG. 14 illustrates a hermetic compressor described in PTL 1. This compressor is a hermetic compressor of a reciprocating type. Weight 102 is provided to hermetic container 101. This weight 102 brings a solid frequency of hermetic container 101 into conformity with a natural frequency of legs 103 each formed of a cushioning member for supporting hermetic container 101. Through a dynamic vibration absorbing effect of legs 103, vibration of hermetic container 101 is damped. In this way, noise is reduced.

It is to be noted that inside hermetic container 101, compression mechanism 104 is provided, and suspension springs 105 are provided for suspending compression mechanism 104 inside hermetic container 101.

Another noise control measure uses a vibration damping plate (refer to, for example, PTL 2).

FIG. 15 illustrates hermetic container 201 of a hermetic compressor described in PTL 2. The compressor is provided with vibration damping plate 202 that is in partial contact with an inner wall surface of hermetic container 201 while having elastic force. Through a contact friction damping effect of contact parts of vibration damping plate 202, vibration of hermetic container 201 is damped, whereby noise is reduced.

The hermetic compressor described in PTL 1 has the vibration of hermetic container 101 damped through the dynamic vibration absorbing effect of legs 103, whereby its noise is reduced. However, there are cases where a satisfactory noise control effect is not obtained when the hermetic compressor is mounted to an appliance, such as a refrigerator, in parts that change in rigidity. Thus, there is a problem of lack of reliability.

In other words, legs 103 are parts where the hermetic compressor is mounted and fixed to the appliance, such as the refrigerator, via grommets or fixtures. However, when fixed to the appliance, legs 103 change their rigidity and reduced mass according to, for example, a shape or material of the grommet or the fixture or a fixed state, thereby changing their natural frequency. For this reason, a great deviation is caused between the natural frequency of hermetic container 101 that is modulated by weight 102 and the natural frequency of legs 103. As a result, a satisfactory dynamic vibration damping effect cannot be exerted, so that the hermetic compressor cannot achieve noise reduction or has a small noise reducing effect, thus lacking reliability.

In addition, the above-described hermetic compressor requires weight 102 having relatively large mass and relatively large volume for the purpose of bringing the natural frequency of hermetic container 101 into conformity with the natural frequency of legs 103. Accordingly, the hermetic compressor has an increased parts count and increased weight, thus becoming high-cost and having an increased size. For this reason, there are cases of such an adverse effect that capacity inside the appliance such as the refrigerator reduces as the appliance has increased mounting capacity.

The hermetic compressor described in PTL 2 has vibration damping plate 202 fixed at fixed part 203 to the inner surface of hermetic container 201 by welding, and contact parts 204*a*, 204*b*, 204*c*, 204*d*, 204*e*, 204*f* of vibration damping plate 202 are in elastic contact with hermetic container 201, whereby the contact friction damping effect is obtained in a relatively wide frequency band. However, there are cases where a satisfactory noise control effect is not obtained. Thus, lack of reliability is problematic. In other words, vibration damping plate 202 of this structure makes elastic contact while undergoing plastic deformation when being fixed by welding to hermetic container 201 at fixed part 203, thus involving contact location variations and contact load variations. As a result, the contact friction damping effect of vibration damping plate 202 varies, and the hermetic compressor may possibly have a small noise reducing effect. Thus, this hermetic compressor lacks reliability.

CITATION LIST

Patent Literature

PTL 1: Unexamined Japanese Patent Publication No. H10-205447

PTL 2: Unexamined Japanese Patent Publication No. H02-159440

SUMMARY OF THE INVENTION

The present invention solves the above conventional problems. The present invention enables a dynamic vibration absorbing effect to be exerted without being affected by an external factor such as a state in which a hermetic compressor is mounted while enabling low cost by preventing a parts count, mass, and volume from increasing. Moreover, the present invention can provide a hermetic compressor that exerts a stable noise control effect while avoiding an insufficient contact friction damping effect of a vibration damping plate.

To solve the above conventional problems, a hermetic compressor according to the present invention includes, inside a hermetic container, an electric motor element, a compression element driven by the electric motor element, and lubricating oil for lubricating the compression element. The hermetic compressor further includes a vibration damping member having one part fixed to the hermetic container and another part being a free end part. Structurally, a natural frequency of the vibration damping member is in substantial conformity with a natural frequency of the hermetic container.

Thus, a dynamic vibration absorbing effect is exerted only with two components, that is, legs of the hermetic container and the vibration damping member. Consequently, noise resulting from vibration of the hermetic container can be reduced. Moreover, since this effect is exerted only with the two components, that is, the hermetic container and the vibration damping member, the dynamic vibration absorbing effect is reliably exerted without being affected by the state in which the hermetic container is mounted to an appliance.

Thus, the hermetic compressor provided by the present invention can reduce the noise irrespective of installation variations and is low-cost and highly reliable.

DESCRIPTION OF EMBODIMENTS

Exemplary embodiments of the present invention will be described hereinafter with reference to the drawings. It is to be noted that the present invention is not limited by these exemplary embodiments.

First Exemplary Embodiment

Figure 1:
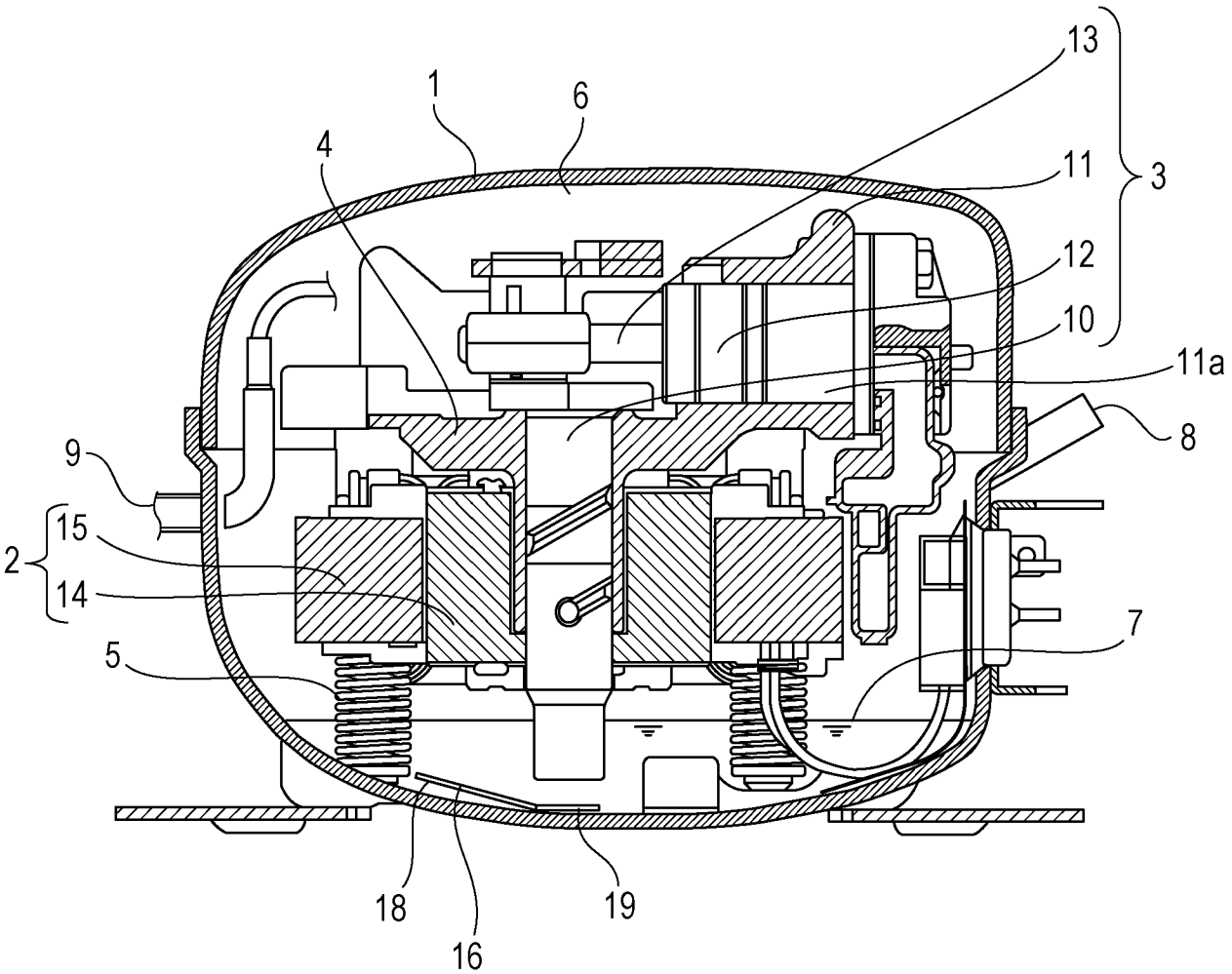
FIG. 1 is a sectional view of a hermetic compressor according to a first exemplary embodiment of the present invention.
Figure 2:
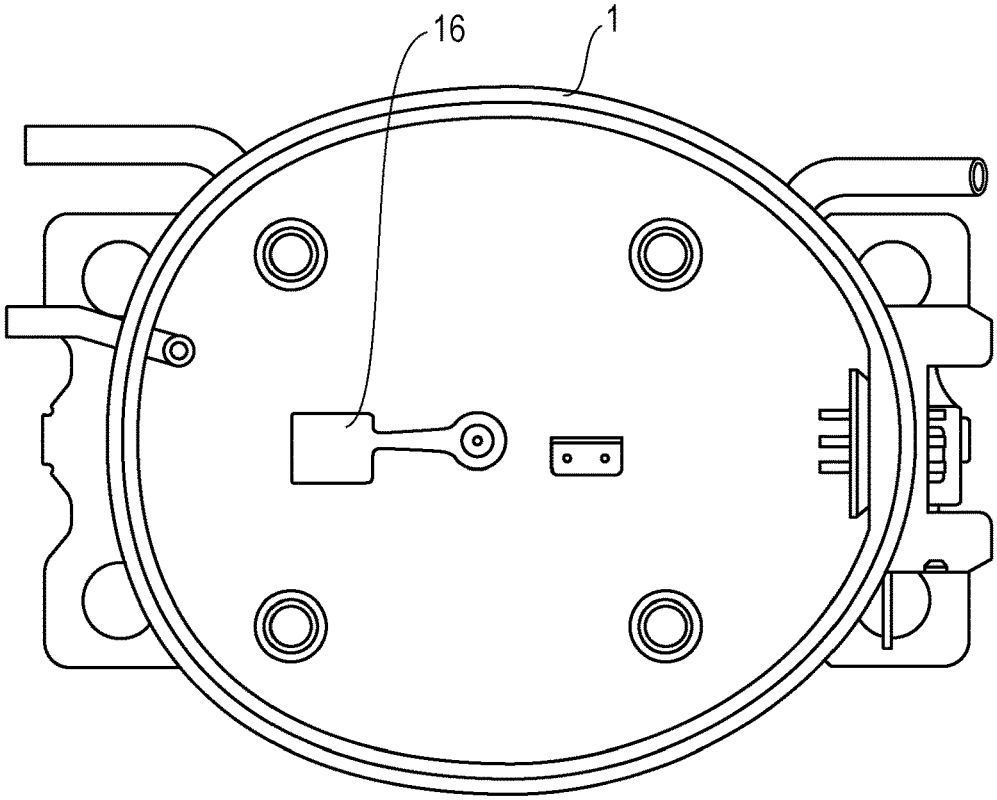
FIG. 2 is a plan view illustrating an inner bottom surface of a hermetic container of the hermetic compressor according to the first exemplary embodiment of the present invention.
Figure 3:
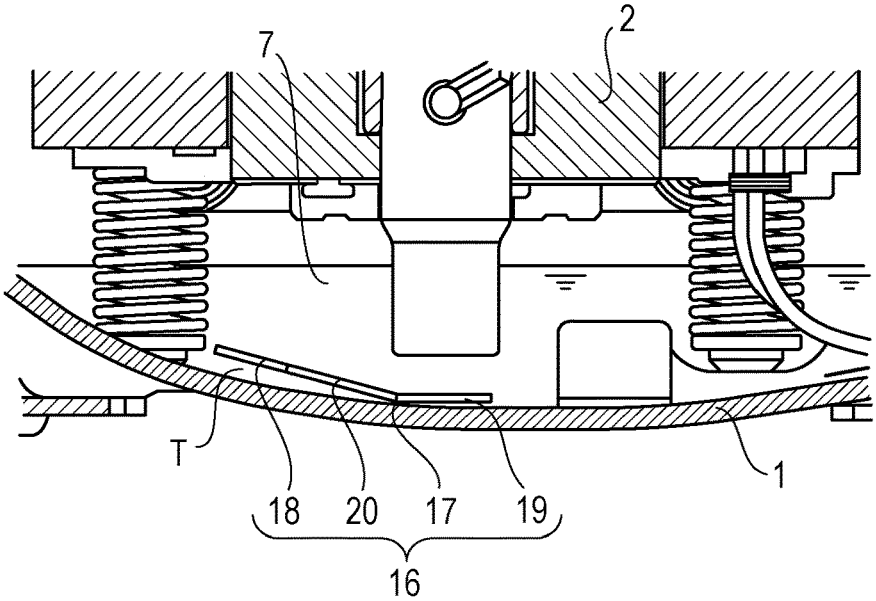
FIG. 3 is an enlarged sectional view of an essential part of the hermetic compressor according to the first exemplary embodiment of the present invention.

FIG. 1 is a sectional view of a hermetic compressor according to the first exemplary embodiment of the present invention. FIG. 2 is a plan view illustrating an inner bottom surface of a hermetic container of the hermetic compressor. FIG. 3 is an enlarged sectional view of an essential part of the hermetic compressor.

Figure 4A:
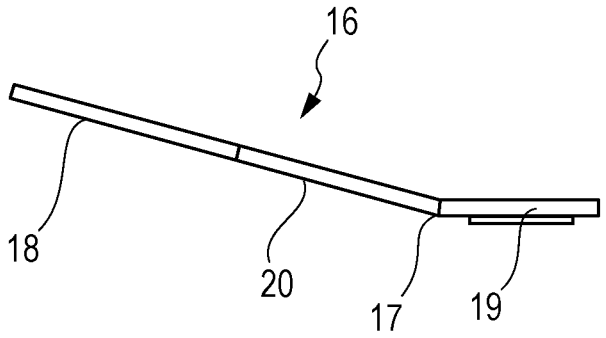
FIG. 4A is a side view of a vibration damping member fixed to the hermetic container of the hermetic compressor according to the first exemplary embodiment of the present invention.
Figure 4B:
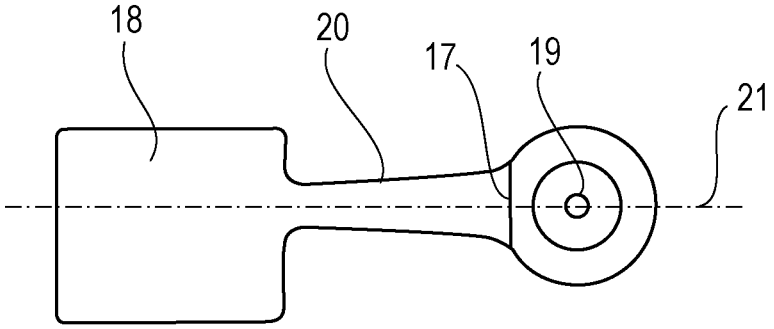
FIG. 4B is a plan view of the vibration damping member fixed to the hermetic container of the hermetic compressor according to the first exemplary embodiment of the present invention.
Figure 5A:
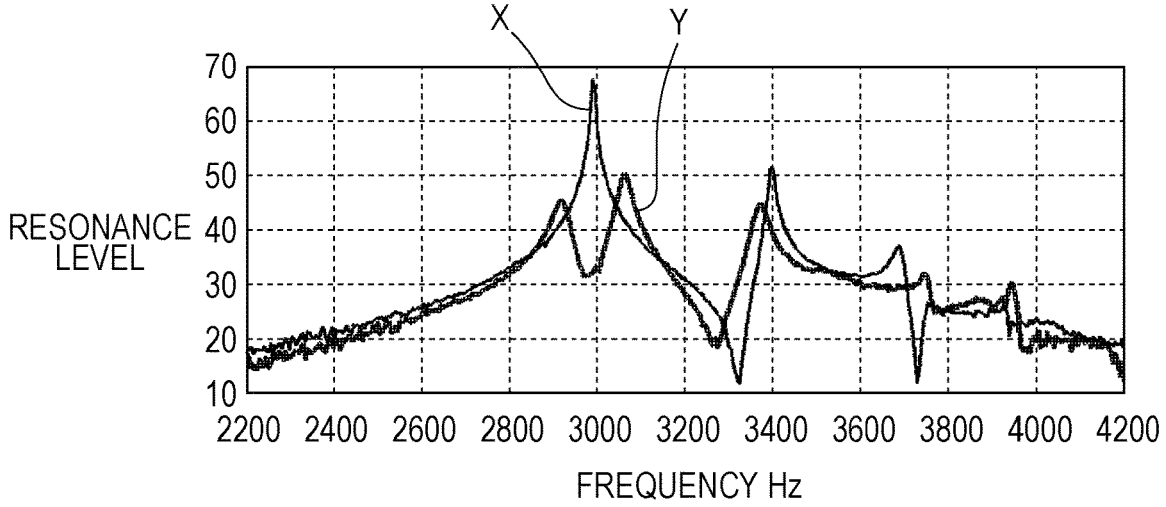
FIG. 5A illustrates a vibrational state of the hermetic container of the hermetic compressor according to the first exemplary embodiment of the present invention.
Figure 5B:
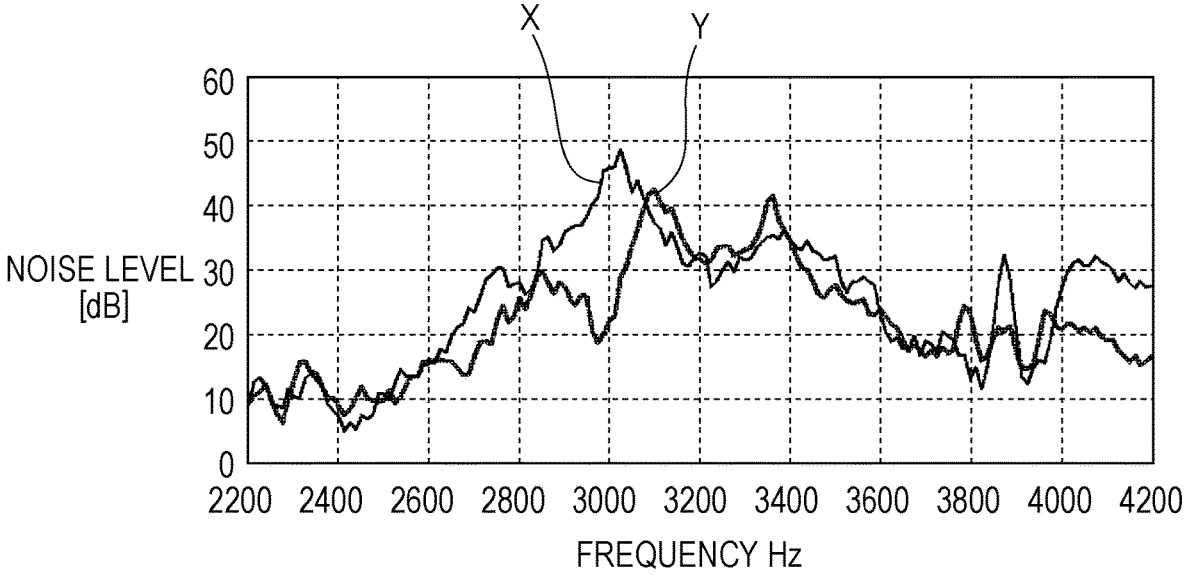
FIG. 5B illustrates a noise condition of the compressor according to the first exemplary embodiment of the present invention.

FIG. 4A is a side view of a vibration damping member fixed to the hermetic container of the hermetic compressor. FIG. 4B is a plan view of the vibration damping member fixed to the hermetic container of the hermetic compressor. FIG. 5A illustrates a vibrational state of the hermetic compressor. FIG. 5B illustrates a noise condition of the hermetic compressor.

FIGS. 6A, 6B, 6C, 6D, 6E, 6F, 6G, 6H, 6I, and 6J each illustrate other examples of the vibration damping member fixed to the hermetic container of the hermetic compressor. FIGS. 7A, 7B, 7C, and 7D are sectional views each schematically illustrating an example of a fixed position of each vibration damping member fixed in the hermetic container of the hermetic compressor.

In FIG. 1, the hermetic compressor according to the present exemplary embodiment has compressor body 4 disposed inside hermetic container 1 formed by draw-forming of an iron plate. Compressor body 4 includes electric motor element 2 and compression element 3 driven by electric motor element 2.

Compressor body 4 is elastically supported by suspension springs 5 inside hermetic container 1.

Hermetic container 1 is filled with, for example, hydrocarbon-based refrigerant gas 6 having a low global warming potential, such as R600a. Lubricating oil 7 is contained at an inner bottom of hermetic container 1.

Hermetic container 1 includes suction pipe 8 that has one end communicating with an interior of hermetic container 1 and another end connected to a low-pressure side (not shown) of a refrigeration device. Hermetic container 1 also includes discharge pipe 9 that has one end passing through hermetic container 1 to communicate with a discharge muffler (not shown) of compression element 3 and another end connected to a high-pressure side (not shown) of the refrigeration device.

Compression element 3 is formed of, for example, shaft 10, cylinder block 11, piston 12, and coupler 13.

Electric motor element 2 is formed of rotor 14 fixed to shaft 10 of compression element 3 by shrinkage fitting and stator 15 positioned around rotor 14. This electric motor element 2 is driven by an inverter drive circuit (not shown) at a plurality of operating frequencies including an operating frequency (for example, 25 Hz=1500 r/min) that is lower than a utility frequency.

In the hermetic compressor configured as described above, as electric motor element 2 is energized, rotor 14 rotates, thus causing reciprocating motion of piston 12 in compression chamber 11*a* of cylinder block 11 via shaft 10 and coupler 13, whereby compression element 3 performs predetermined compression.

This means that the reciprocating motion of piston 12 causes the working fluid of the refrigeration device to be sucked into hermetic container 1 through suction pipe 8. The working fluid inside hermetic container 1 is sucked into compression chamber 11*a* via a suction valve for compression and is discharged via a discharge valve and the discharge muffler and then from discharge pipe 9 toward the high-pressure side of the refrigeration device.

Here, the compression causes pulsation to the working fluid in the hermetic compressor, whereby compressor body 4 elastically supported by suspension springs 5 also experiences pulsation and is excited by other vibrations. In association with this, hermetic container 1 is excited, thereby vibrating and generating noise.

Accordingly, vibration damping member 16 is mounted to hermetic container 1 in the present exemplary embodiment for damping the vibration of hermetic container 1.

As shown in FIG. 3, vibration damping member 16 has a part fixed by welding, for example to a part where amplitude of hermetic container 1 is greatest, such as the inner bottom surface of hermetic container 1, while another part of vibration damping member 16 is vibratable by having bend 17, thus forming a free end part. Clearance T is defined between free end part 18 and the bottom surface of the hermetic container.

A natural frequency of free end part 18 of vibration damping member 16 is brought into substantial conformity with a natural frequency of hermetic container 1, whereby a dynamic vibration absorbing effect is exerted.

In the present exemplary embodiment, as shown in FIGS. 4A and 4B, vibration damping member 16 is such that one end part of a metal plate such as an iron plate is defined as fixed part 19 fixed to the hermetic container, while another end part of the metal plate is defined as free end part 18 with narrow connection part 20 being between fixed part 19 and free end part 18. Free end part 18 of vibration damping member 16 is formed to be wider than connection part 20 and has such a shape that its side is wider. In other words, free end part 18 of vibration damping member 16 is formed such that vibration damping member 16 as a whole is unbalanced in weight with respect to axis 21.

As is clear from FIG. 3, vibration damping member 16 is fixed to the inner bottom surface of hermetic container 1 so as to be entirely immersed in lubricating oil 7 inside hermetic container 1.

A description is provided next of functional effects of vibration damping member 16 configured as described above.

Vibration damping member 16 has fixed part 19 fixed to the inner bottom surface of hermetic container 1 and free end part 18 that is vibratable. The natural frequency of vibration damping member 16 is in substantial conformity with the natural frequency of hermetic container 1, so that vibration damping member 16 exerts the dynamic vibration absorbing effect, thereby damping the vibration of hermetic container 1 and reducing the noise.

Here, the dynamic vibration absorbing effect is exerted by bringing the natural frequency of vibration damping member 16 that is partly fixed to hermetic container 1 into substantial conformity with the natural frequency of hermetic container 1. In other words, the dynamic vibration absorbing effect is exerted only with the two components, that is, vibration damping member 16 and hermetic container 1. Therefore, the dynamic vibration absorbing effect does not show a decline such as seen conventionally because the natural frequency of hermetic container 1 remains unaffected by a state in which hermetic container 1 is mounted to the device. The dynamic vibration absorbing effect is thus reliably exerted.

With the vibration of hermetic container 1 damped, a noise control effect is reliably obtained as intended.

As described above, the structure of the present exemplary embodiment is such that the natural frequency of vibration damping member 16 is in substantial conformity with the natural frequency of hermetic container 1, so that even in cases where the hermetic compressor is of a reciprocating type, noise peculiar to the reciprocating type can be reliably reduced. In other words, if the natural frequency of hermetic container 1 is an oscillation frequency of a harmonic of, for example, valve tapping noise of compression element 3 in a range of about 2 kHz to 8 kHz, the natural frequency of vibration damping member 16 has only to be brought into substantial conformity with this oscillation frequency. In this way, vibration damping member 16 maintains its natural frequency without being affected by other factors including a conventional factor such as a state in which legs are mounted. Consequently, the harmonic noise, which is peculiar to the reciprocating type, in the band ranging from about 2 kHz to 8 kHz can also be reliably reduced.

FIGS. 5A and 5B show a vibrational state of the hermetic container and a noise condition of the hermetic compressor, respectively. FIG. 5A illustrates the vibrational state of the hermetic container of the hermetic compressor according to the first exemplary embodiment of the present invention. FIG. 5B illustrates the noise condition of the hermetic compressor. In FIGS. 5A and 5B, the vibrational state and the noise condition of a conventional hermetic container without vibration damping member 16 are indicated by X. The vibrational state and the noise condition of hermetic container 1 of the present exemplary embodiment that is provided with vibration damping member 16 for the dynamic vibration absorbing effect are indicated by Y. It is to be noted that vibration damping member 16 is the one shown in FIGS. 4A and 4B.

As is clear from FIG. 5A, peaks of the vibration of hermetic container 1 are greatly suppressed in Y indicating the vibrational state of the present exemplary embodiment, and as is clear from FIG. 5B, peak values of the noise are also greatly lowered in Y indicating the noise condition of the present exemplary embodiment.

In the present exemplary embodiment, the dynamic vibration absorbing effect for noise reduction is exerted by fixing vibration damping member 16 so that vibration damping member 16 is vibratable and by bringing the natural frequency of the vibration damping member itself into substantial conformity with the natural frequency of hermetic container 1. Thus, there is not required a member that brings the natural frequency of hermetic container 1 into conformity with the natural frequency of vibration damping member 16, such as a conventional weight. This means that a parts count and a man-hour can be reduced accordingly.

Vibration damping member 16 has fixed part 19 fixed to the bottom surface where the resonance amplitude of hermetic container 1 is greatest, so that the dynamic vibration absorbing effect is exerted at a part where a loud noise is generated with the greatest amplitude. The dynamic vibration absorbing effect is thus enhanced, enabling effective reduction of the noise resulting from the vibration of the hermetic container as shown in FIG. 5B.

Vibration damping member 16 is provided inwardly of hermetic container 1. Noise caused by resonance of vibration damping member 16 can be isolated by hermetic container 1, whereby the noise can be further reduced.

In addition, vibration damping member 16 is provided to be positioned in lubricating oil 7 at the bottom of hermetic container 1, whereby a vibration damping effect can be obtained from viscous resistance of lubricating oil 7 in addition to the dynamic vibration absorbing effect obtained from vibration damping member 16. This means that the resonance peaks of hermetic container 1 can be lowered accordingly, whereby the noise can be further reduced.

Vibration damping member 16 is formed of the iron plate, so that its structure is very simple, thus enabling size reduction and cost reduction. Moreover, addition of vibration damping member 16 prevents hermetic container 1 from being increased in size and cost, so that the hermetic compressor can be made compact and low-cost.

Furthermore, in the hermetic compressor shown as an example in the present exemplary embodiment, electric motor element 2 is driven by the inverter at the plurality of operating frequencies. Accordingly, compression element 3 performs compression at variable speeds, and it is thus conceivable that a magnitude of the amplitude of hermetic container 1 varies. However, hermetic container 1 of the hermetic compressor is provided with vibration damping member 16. Vibration damping member 16 can reliably exert the dynamic vibration absorbing effect correspondingly to amplitude variations of hermetic container 1, thereby reducing the noise.

In the present exemplary embodiment, hermetic container 1 of the hermetic compressor is substantially spherical. For this reason, in addition to a vibration (hereinafter referred to as a principal vibration) generated in a direction orthogonal to the fixed surface of hermetic container 1 that has vibration damping member 16 fixed thereto, a plurality of relatively weak vibrations (hereinafter referred to as secondary vibrations) are generated in the fixed surface of hermetic container 1 in respective directions crossing the direction of the principal vibration. In other words, three-dimensional complex vibration presumably takes place.

However, vibration damping member 16 shown as an example in the present exemplary embodiment vibrates torsionally in response to the three-dimensional vibration of hermetic container 1, thereby exerting its dynamic vibration absorbing effect with accuracy. Accordingly, the noise resulting from the vibration of hermetic container 1 can be reduced intensively.

Specifically, vibration damping member 16 is formed of the plate-shaped member and has narrow connection part 20 between fixed part 19 and free end part 18, thus lending itself to torsion. By vibrating torsionally in response to the three-dimensional vibration, vibration damping member 16 exerts the dynamic vibration absorbing effect.

Free end part 18 of vibration damping member 16 is made wider than narrow connection part 20 to have a substantially greater weight. Even in this way, vibration damping member 16 vibrates torsionally to exert the dynamic vibration absorbing effect.

Furthermore, a widthwise shape of free end part 18 is offset to one side so that vibration damping member 16 as a whole is unbalanced in weight with respect to axis 21. Even in this way, vibration damping member 16 vibrates torsionally to exert the dynamic vibration absorbing effect.

In these ways, vibration damping member 16 vibrates torsionally in response to the vibration of hermetic container 1, thereby maximizing its exertion of the dynamic vibration absorbing effect. The vibration of hermetic container 1 is thus damped with accuracy, whereby the noise can be reduced.

Figure 6A:
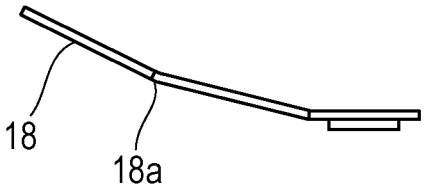
FIG. 6A illustrates another first example of the vibration damping member fixed to the hermetic container of the hermetic compressor according to the first exemplary embodiment of the present invention.
Figure 6B:
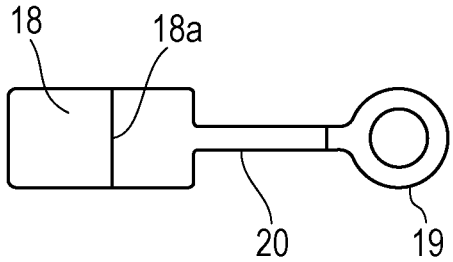
FIG. 6B illustrates another second example of the vibration damping member fixed to the hermetic container of the hermetic compressor according to the first exemplary embodiment of the present invention.
Figure 6C:
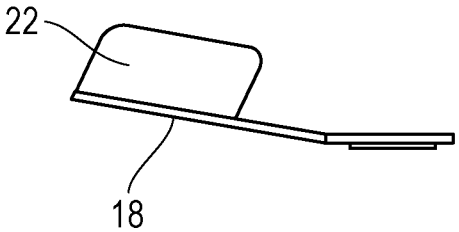
FIG. 6C illustrates another third example of the vibration damping member fixed to the hermetic container of the hermetic compressor according to the first exemplary embodiment of the present invention.
Figure 6D:
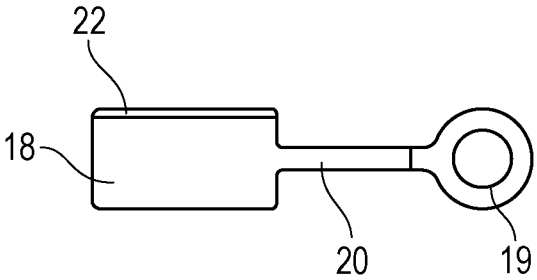
FIG. 6D illustrates another fourth example of the vibration damping member fixed to the hermetic container of the hermetic compressor according to the first exemplary embodiment of the present invention.
Figure 6E:
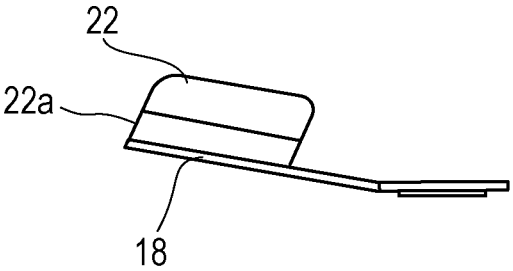
FIG. 6E illustrates another fifth example of the vibration damping member fixed to the hermetic container of the hermetic compressor according to the first exemplary embodiment of the present invention.
Figure 6F:
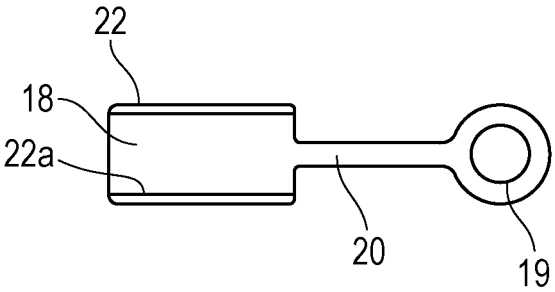
FIG. 6F illustrates another sixth example of the vibration damping member fixed to the hermetic container of the hermetic compressor according to the first exemplary embodiment of the present invention.
Figure 6G:
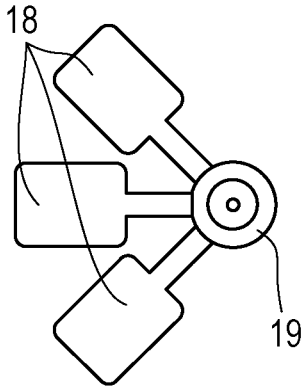
FIG. 6G illustrates another seventh example of the vibration damping member fixed to the hermetic container of the hermetic compressor according to the first exemplary embodiment of the present invention.
Figure 6H:
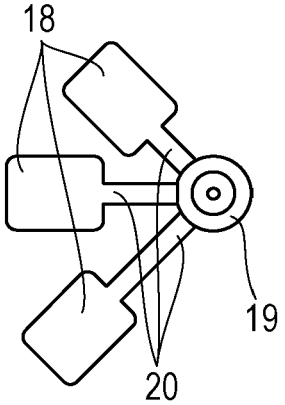
FIG. 6H illustrates another eighth example of the vibration damping member fixed to the hermetic container of the hermetic compressor according to the first exemplary embodiment of the present invention.
Figure 6I:
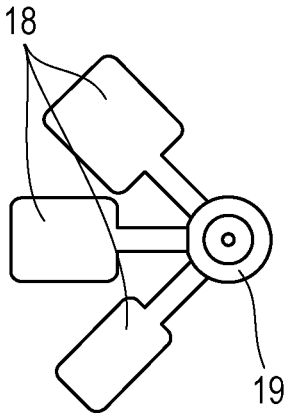
FIG. 6I illustrates another ninth example of the vibration damping member fixed to the hermetic container of the hermetic compressor according to the first exemplary embodiment of the present invention.
Figure 6J:
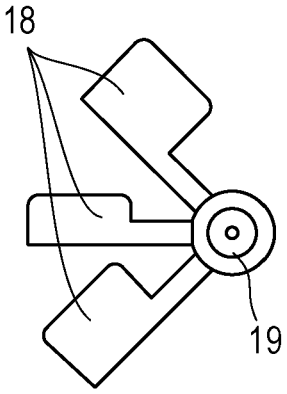
FIG. 6J illustrates another tenth example of the vibration damping member fixed to the hermetic container of the hermetic compressor according to the first exemplary embodiment of the present invention.

Other conceivable examples of vibration damping member 16 that vibrate torsionally include those shown in FIGS. 6A, 6B, 6C, 6D, 6E, 6F, 6G, 6H, 6I and 6J. FIG. 6A illustrates another first example of vibration damping member 16 fixed to hermetic container 1 of the hermetic compressor according to the first exemplary embodiment of the present invention. FIG. 6B illustrates another second example of vibration damping member 16 fixed to hermetic container 1 of the hermetic compressor. FIG. 6C illustrates another third example of vibration damping member 16 fixed to hermetic container 1 of the hermetic compressor. FIG. 6D illustrates another fourth example of vibration damping member 16 fixed to hermetic container 1 of the hermetic compressor. FIG. 6E illustrates another fifth example of vibration damping member 16 fixed to hermetic container 1 of the hermetic compressor. FIG. 6F illustrates another sixth example of vibration damping member 16 fixed to hermetic container 1 of the hermetic compressor. FIG. 6G illustrates another seventh example of vibration damping member 16 fixed to hermetic container 1 of the hermetic compressor. FIG. 6H illustrates another eighth example of vibration damping member 16 fixed to hermetic container 1 of the hermetic compressor. FIG. 6I illustrates another ninth example of vibration damping member 16 fixed to hermetic container 1 of the hermetic compressor. FIG. 6J illustrates another tenth example of vibration damping member 16 fixed to hermetic container 1 of the hermetic compressor.

FIGS. 6A and 6B each show free end part 18 itself further having bend 18*a*. By having bend 18*a*, vibration damping member 16 as a whole vibrates in a complicated manner and vibrates torsionally.

FIGS. 6C and 6D each show free end part 18 provided with rising piece 22 along its long side. Providing rising piece 22 along the long side results in an increased weight of free end part 18 of vibration damping member 16. Vibration damping member 16 thus becomes unbalanced in weight with respect to axis 21. In this way, vibration damping member 16 vibrates torsionally.

FIGS. 6E and 6F each show free end part 18 provided with rising pieces 22, 22*a* of different heights along its respective sides. Rising pieces 22, 22*a* result in an increased weight of free end part 18 of vibration damping member 16 in a manner similar to rising pieces 22 in FIGS. 6C and 6D. With rising pieces 22, 22*a* having the different heights, vibration damping member 16 becomes unbalanced in weight with respect to the axis. In this way, vibration damping member 16 vibrates torsionally.

FIGS. 6G, 6H, 6I, and 6J each show a plurality of free end parts 18 (for example, three free end parts 18) provided for fixed part 19. In FIG. 6G, the plurality of free end parts 18 has the same natural frequency. In FIG. 6H, connection parts 20 differ in length, so that free end parts 18 have different natural frequencies. In FIG. 6I, free end parts 18 differ in size, thus having different natural frequencies. In FIG. 6J, free end parts 18 differ in shape, thus having different natural frequencies.

Any of vibration damping members 16 exerts the dynamic vibration absorbing effect at free end part 18. Thus, resonance of hermetic container 1 can be damped more effectively, and the noise can be reduced. Those structures each having the plurality of free end parts 18 with different natural frequencies can damp resonances of different natural frequencies, thereby further reducing the noise.

As described above, each of vibration damping members 16 shown herein as the examples in the present exemplary embodiment is formed of the plate-shaped member and has narrow connection part 20 between fixed part 19 and free end part 18, to begin with. Accordingly, vibration damping member 16 lends itself torsion and exerts the dynamic vibration absorbing effect by vibrating torsionally in response to the three-dimensional vibration.

Moreover, vibration damping member 16 has free end part 18 that is made, for example, wider than narrow connection part 20 so that free end part 18 has a substantially greater weight, or vibration damping member 16 has free end part 18 that is provided with rising piece 22 so that free end part 18 has a greater weight. Even in these ways, vibration damping member 16 lends itself to torsion and exerts the dynamic vibration absorbing effect by vibrating torsionally in response to the three-dimensional vibration.

Furthermore, vibration damping member 16 has an axis of free end part 18 offset with respect to fixed part 19 or, alternatively, has axes of both connection part 20 and free end part 18 offset with respect to fixed part 19, thereby being unbalanced in weight as a whole with respect to the axis. Even in these ways, vibration damping member 16 lends itself to torsion and exerts the dynamic vibration absorbing effect by vibrating torsionally in response to the three-dimensional vibration.

Still furthermore, vibration damping member 16 has free end part 18 provided with rising piece 22 that is, for example, inclined. In this way, vibration damping member 16 lends itself to torsion even in response to a vibration component of a component force caused by an inclination of rising piece 22 during vibration of free end part 18 and exerts the dynamic vibration absorbing effect by vibrating torsionally in response to the three-dimensional vibration.

By having all the structures described above, vibration damping member 16 maximizes its exertion of the dynamic vibration absorbing effect through its torsional vibration. However, vibration damping member 16 can enhance its dynamic vibration absorbing effect by having at least one of these structures, thereby improving a noise reducing effect resulting from the vibration of hermetic container 1.

Vibration damping member 16 is mounted in a position that is not limited to the above-mentioned container bottom surface, and various mounting positions are conceivable.

Figure 7A:
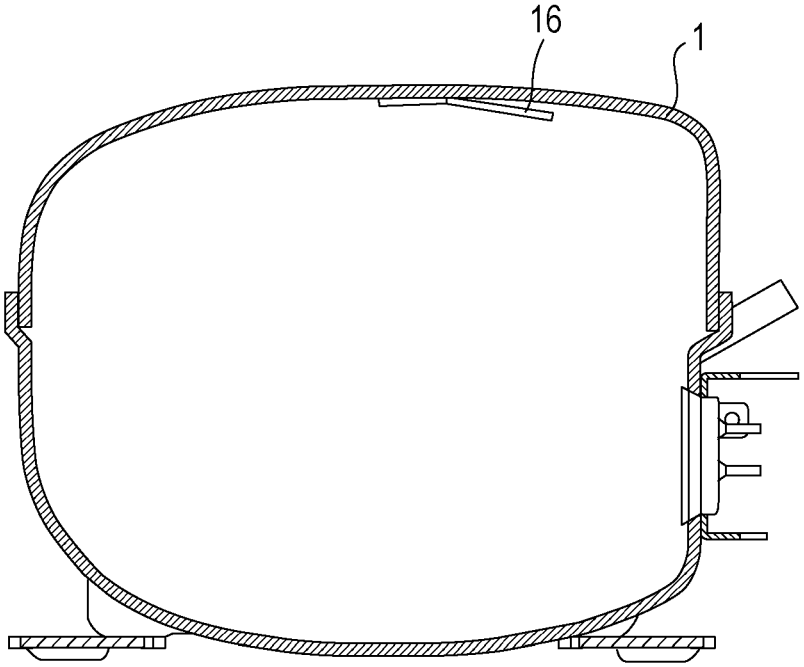
FIG. 7A is a sectional view schematically illustrating another first example of fixing a vibration damping member to the hermetic container of the hermetic compressor according to the first exemplary embodiment of the present invention.
Figure 7B:
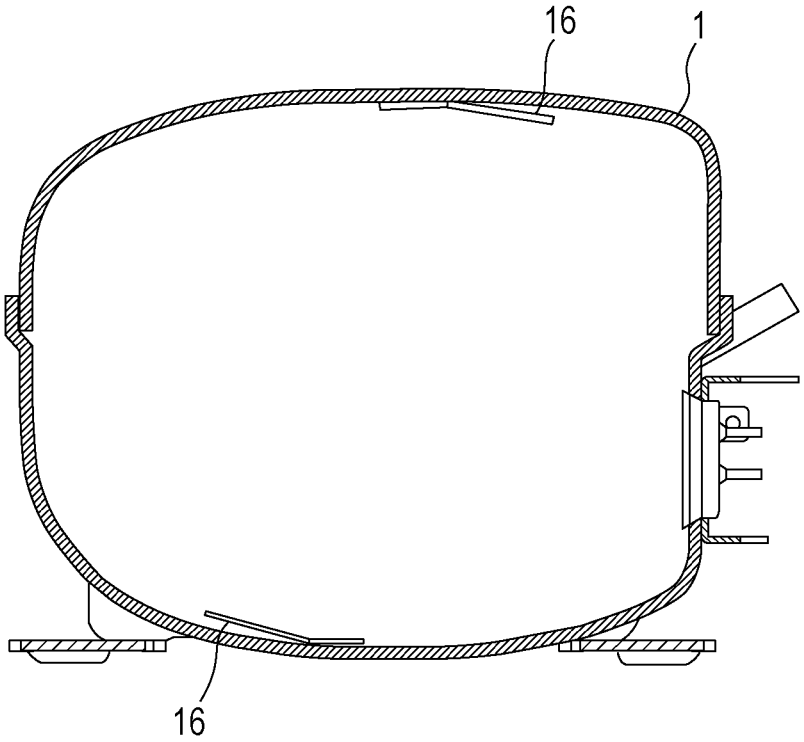
FIG. 7B is a sectional view schematically illustrating another second example of fixing vibration damping members to the hermetic container of the hermetic compressor according to the first exemplary embodiment of the present invention.
Figure 7C:
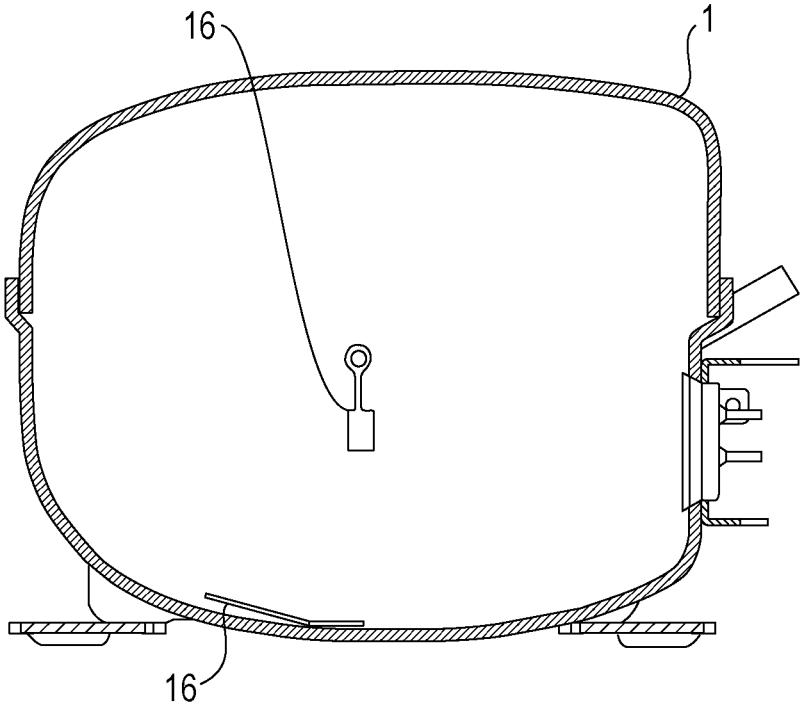
FIG. 7C is a sectional view schematically illustrating another third example of fixing vibration damping members to the hermetic container of the hermetic compressor according to the first exemplary embodiment of the present invention.
Figure 7D:
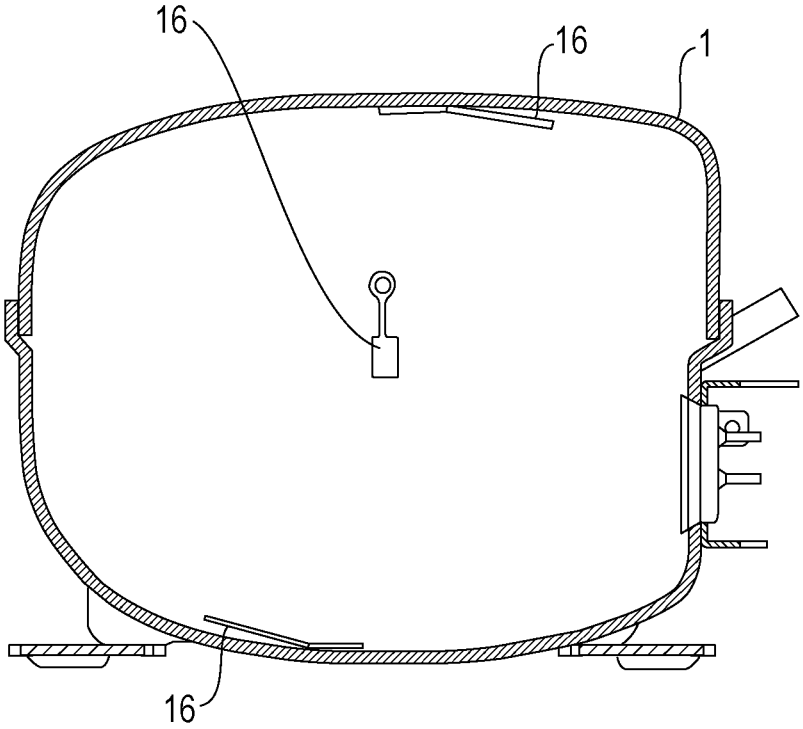
FIG. 7D is a sectional view schematically illustrating another fourth example of fixing vibration damping members to the hermetic container of the hermetic compressor according to the first exemplary embodiment of the present invention.

FIG. 7A is a sectional view schematically illustrating another first example of fixing vibration damping member 16 to hermetic container 1 of the hermetic compressor according to the first exemplary embodiment of the present invention. FIG. 7B is a sectional view schematically illustrating another second example of fixing vibration damping member 16 to hermetic container 1 of the hermetic compressor. FIG. 7C is a sectional view schematically illustrating another third example of fixing vibration damping member 16 to hermetic container 1 of the hermetic compressor. FIG. 7D is a sectional view schematically illustrating another fourth example of fixing vibration damping member 16 to hermetic container 1 of the hermetic compressor.

The example shown in FIG. 7A is such that vibration damping member 16 is mounted to a ceiling surface of hermetic container 1. The example shown in FIG. 7B is such that vibration damping members 16 are mounted in two respective positions of the bottom surface and the ceiling surface of hermetic container 1. The example shown in FIG. 7C is such that vibration damping members 16 are mounted in two respective positions of the bottom surface and a side surface of hermetic container 1. The example shown in FIG. 7D is such that vibration damping members 16 are mounted in three respective positions of the bottom surface, the ceiling surface, and the side surface of hermetic container 1. A suitable mounting position for vibration damping member 16 may be selected according to the natural frequency of hermetic container 1. Moreover, a shape of vibration damping member 16 may be one of those including the shape shown in FIGS. 4A and 4B and the respective shapes shown in FIGS. 6A to 6J, or vibration damping members 16 having these shapes may be combined for use. Using the combination of vibration damping members 16 in the respective examples is effective in the exertion of the dynamic vibration absorbing effect because the natural frequency of vibration damping member 16 can be brought into conformity with the natural frequency of hermetic container 1 with more accuracy.

As described above, the hermetic compressor according to the present exemplary embodiment includes, inside hermetic container 1, electric motor element 2, compression element 3 driven by electric motor element 2, and lubricating oil 7 for lubricating compression element 3. The hermetic compressor further includes vibration damping member 16 having the one part fixed to hermetic container 1 and another part being free end part 18. Structurally, the natural frequency of vibration damping member 16 is in substantial conformity with the natural frequency of hermetic container 1.

Thus, the dynamic vibration absorbing effect is exerted only with the two components, that is, legs of the hermetic container and the vibration damping member. Consequently, the noise resulting from the vibration of the hermetic container can be reduced. Moreover, since this effect is exerted only with the two components, that is, the hermetic container and the vibration damping member, the dynamic vibration absorbing effect is reliably exerted without being affected by the state in which the hermetic container is mounted to the device. In other words, the dynamic vibration absorbing effect is fully exerted because the natural frequency of either the vibration damping member or the hermetic container does not vary to cause a decline in this effect. With the vibration of the hermetic container damped, the noise control effect can be reliably obtained. Even in cases where the hermetic compressor is of the reciprocating type, the harmonic noise peculiar to the reciprocating type in the resonance frequency band (2 kHz to 8 kHz) can be reliably reduced. In addition, the dynamic vibration absorbing effect is effected by fixing the vibration damping member so that the vibration damping member is vibratable and by bringing the natural frequency of the vibration damping member itself into conformity with the natural frequency of the hermetic container, thus not requiring a member such as a weight that brings the natural frequency of the hermetic container into conformity with the natural frequency of the vibration damping member. This means that the parts count and the man-hour can be reduced accordingly.

Vibration damping member 16 may be formed to have the plurality of free end parts 18.

The dynamic vibration absorbing effect is thus exerted at each of free end parts 18. Accordingly, the resonance of hermetic container 1 can be damped more effectively, and the noise can be reduced.

Vibration damping member 16 may be formed to have the plurality of free end parts 18 having the different natural frequencies.

The resonances having the different natural frequencies can thus be damped. Accordingly, the noise can be further reduced.

The plurality of vibration damping members 16 may be provided.

The dynamic vibration absorbing effect can thus be exerted at the plurality of positions, whereby a more intensive resonance damping effect can be obtained. Accordingly, a further noise reducing effect is expected.

Vibration damping member 16 may have fixed part 19 fixed to a part where the amplitude of the natural frequency of hermetic container 1 is greatest.

The dynamic vibration absorbing effect is thus exerted at the part where the loud noise is generated with the greatest amplitude. Accordingly, the dynamic vibration absorbing effect is enhanced, enabling effective reduction of the noise resulting from the vibration of the hermetic container.

Vibration damping member 16 may be provided inwardly of hermetic container 1.

The noise caused by the resonance of vibration damping member 16 can be isolated by hermetic container 1, whereby the noise can be further reduced.

Vibration damping member 16 may be provided to be positioned in lubricating oil 7 at the bottom of hermetic container 1.

The vibration damping effect can thus be obtained from the viscous resistance of lubricating oil 7 in addition to the dynamic vibration absorbing effect obtained from vibration damping member 16. This means that the resonance peaks of hermetic container 1 can be lowered accordingly, whereby the noise can be further reduced.

Vibration damping member 16 may be formed of the iron plate.

This enables the size reduction and the cost reduction of the vibration damping member. Accordingly, hermetic container 1 can be prevented from being increased in size and cost, so that the hermetic compressor can be made compact and low-cost.

Compression element 3 may be of the reciprocating type.

The harmonic noise peculiar to the reciprocating type in the resonance frequency band (2 kHz to 8 kHz) can thus be reliably reduced.

Driving at the plurality of operating frequencies may be caused by the inverter.

Even when the amplitude of hermetic container 1 varies as the compression mechanism performs compression at the variable speeds, vibration damping member 16 can reliably exert the dynamic vibration absorbing effect correspondingly to the amplitude variations, thereby reducing the noise.

Second Exemplary Embodiment

Figure 8:
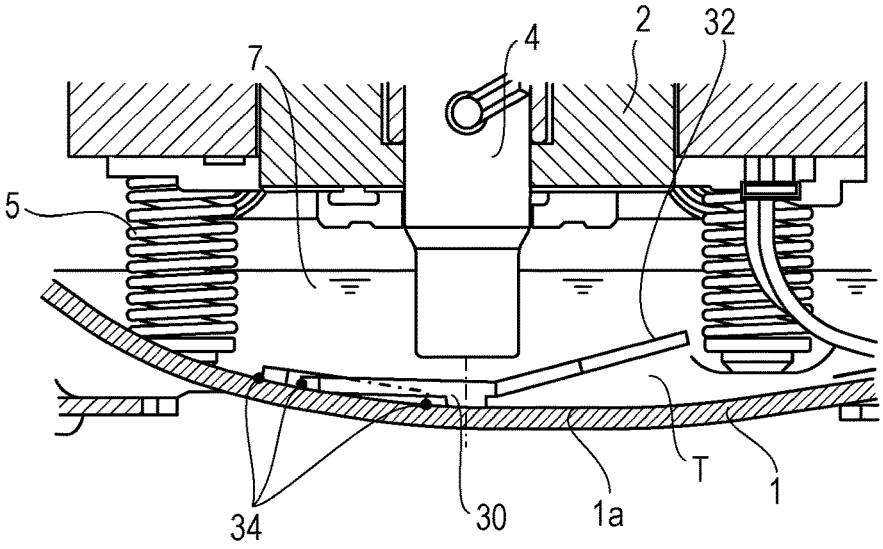
FIG. 8 is an enlarged sectional view of an essential part of a hermetic compressor according to a second exemplary embodiment of the present invention.
Figure 9:
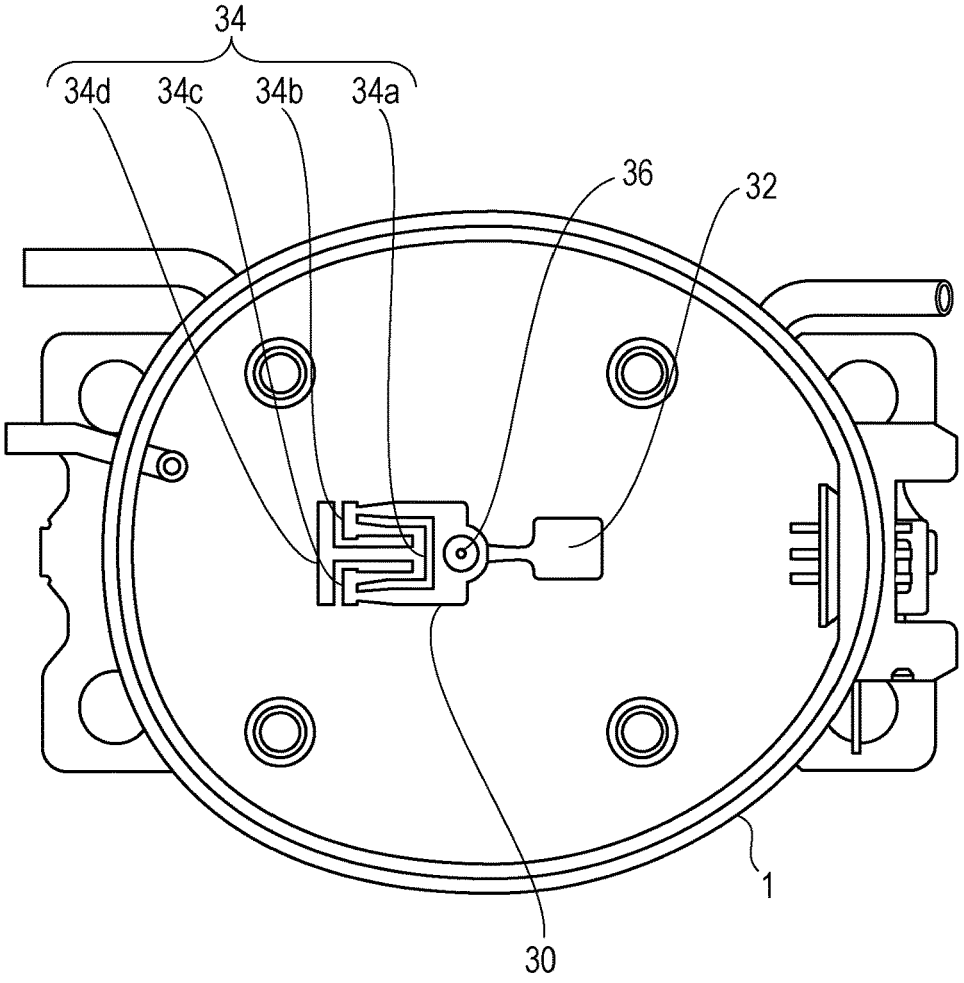
FIG. 9 is a plan view illustrating an inner bottom surface of a hermetic container of the hermetic compressor according to the second exemplary embodiment of the present invention.

FIG. 8 is an enlarged sectional view of an essential part of a hermetic compressor according to the second exemplary embodiment of the present invention. FIG. 9 is a plan view illustrating an inner bottom surface of hermetic container 1 of the hermetic compressor.

Figure 10A:
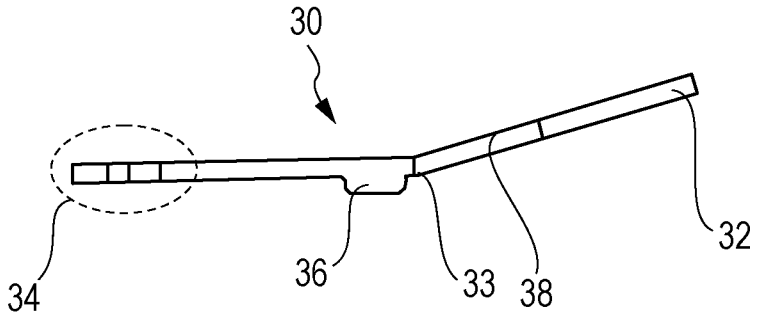
FIG. 10A is a side view of a vibration damping member of the hermetic compressor according to the second exemplary embodiment of the present invention.
Figure 10B:
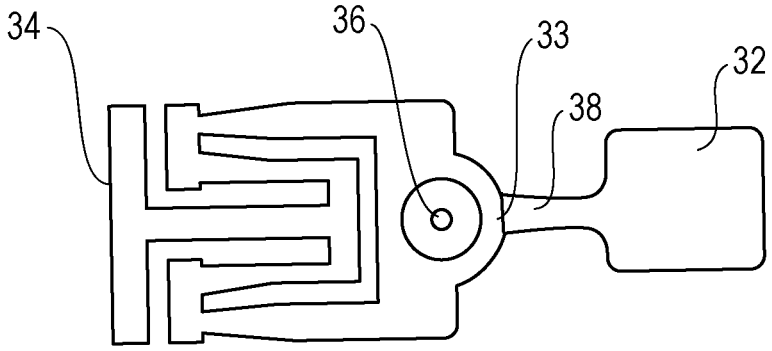
FIG. 10B is a plan view of the vibration damping member of the hermetic compressor according to the second exemplary embodiment of the present invention.
Figure 11A:
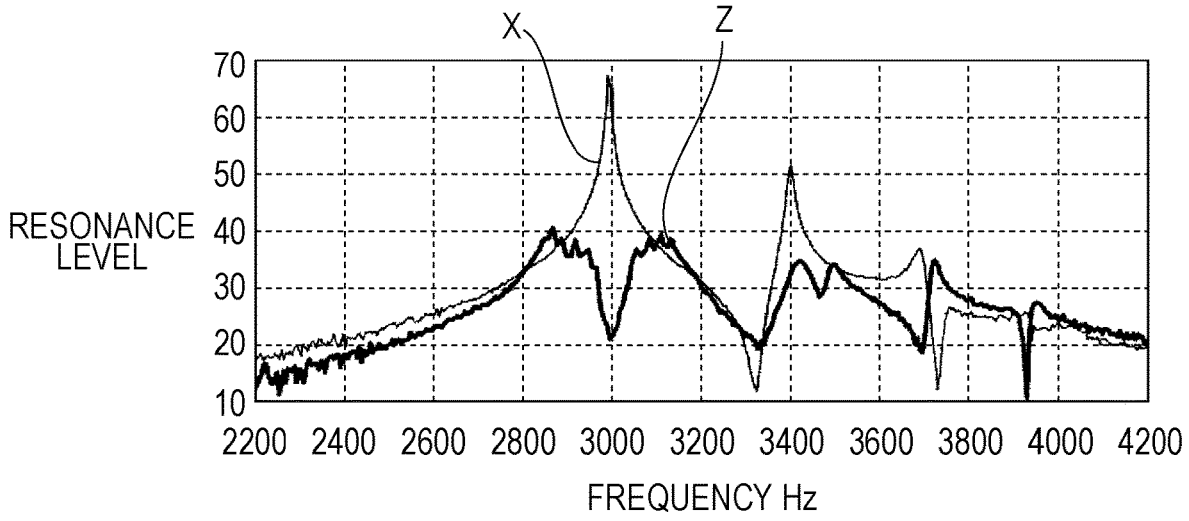
FIG. 11A illustrates a vibrational state of the hermetic container of the hermetic compressor according to the second exemplary embodiment of the present invention.
Figure 11B:
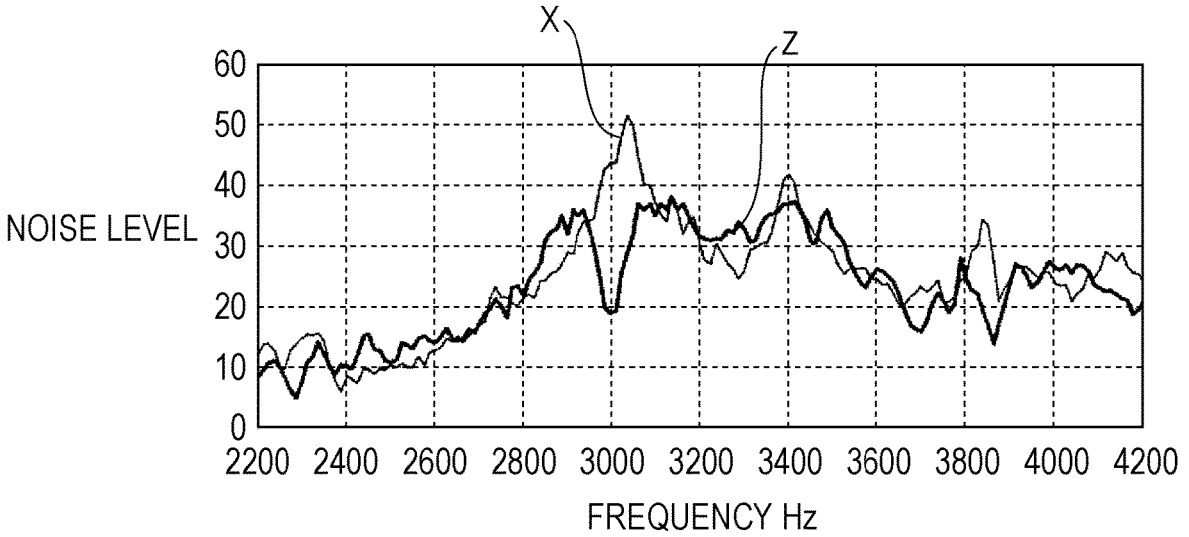
FIG. 11B illustrates a noise condition of the hermetic compressor according to the second exemplary embodiment of the present invention.

FIG. 10A is a side view of a vibration damping member of the hermetic compressor. FIG. 10B is a plan view of the vibration damping member of the hermetic compressor. FIG. 11A illustrates a vibrational state of the hermetic container of the hermetic compressor. FIG. 11B illustrates a noise condition of the hermetic compressor.

Figure 12A:
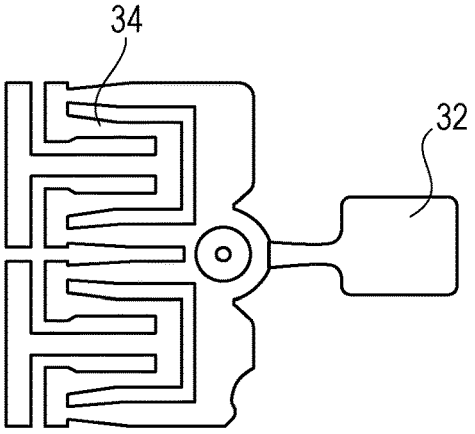
FIG. 12A illustrates another example of the vibration damping member of the hermetic compressor according to the second exemplary embodiment of the present invention.
Figure 12B:
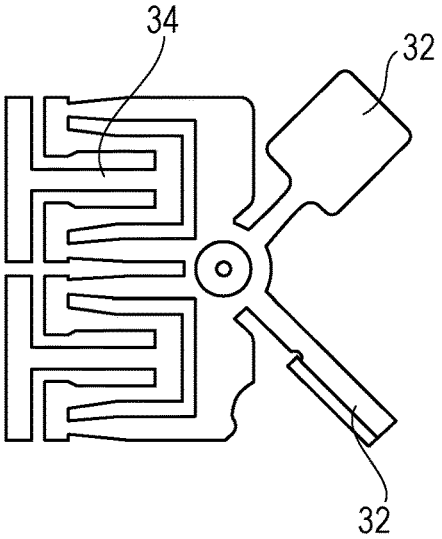
FIG. 12B illustrates another example of the vibration damping member of the hermetic compressor according to the second exemplary embodiment of the present invention.
Figure 12C:
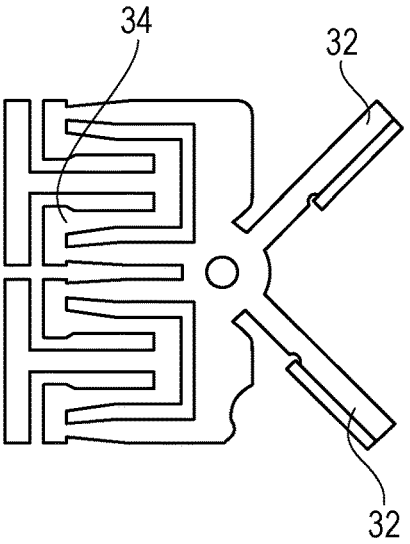
FIG. 12C illustrates another example of the vibration damping member of the hermetic compressor according to the second exemplary embodiment of the present invention.

FIG. 12A illustrates another first example of the vibration damping member of the hermetic compressor. FIG. 12B illustrates another second example of the vibration damping member of the hermetic compressor. FIG. 12C illustrates another third example of the vibration damping member of the hermetic compressor.

It is to be noted that except for the vibration damping member, elements of the hermetic compressor of the present exemplary embodiment are structurally the same as those of the first exemplary embodiment, thus having the same reference marks, and descriptions of those elements are omitted.

In FIG. 8, the hermetic compressor according to the present exemplary embodiment has compressor body 4 disposed inside hermetic container 1 formed by draw forming of an iron plate.

Compressor body 4 is elastically supported by suspension springs 5 inside hermetic container 1. Lubricating oil 7 is contained at an inner bottom of hermetic container 1.

In the hermetic compressor configured as described above, as electric motor element 2 is energized, compressor body 4 performs predetermined compression, whereby working fluid of a refrigeration device is sucked into hermetic container 1, compressed and discharged toward a high-pressure side of the refrigeration device.

Here, the compression causes pulsation to the working fluid in the hermetic compressor, whereby compressor body 4 elastically supported by suspension springs 5 also experiences pulsation and is excited by other vibrations. In association with this, hermetic container 1 is excited, thereby vibrating and generating noise.

Accordingly, vibration damping member 30 is mounted to hermetic container 1 in the present exemplary embodiment for damping the vibration of hermetic container 1.

As shown in FIGS. 8, 9, 10A, and 10B, vibration damping member 30 has a part fixed by welding, for example to a part where amplitude of hermetic container 1 is greatest, such as inner bottom surface 1*a* of hermetic container 1. Another part of vibration damping member 30 is vibratable by having bend 33, thus forming free end part 32 with clearance T defined between free end part 32 and inner bottom surface 1*a* of hermetic container 1. Meanwhile, still another part of vibration damping member 30, other than free end part 32, is in elastic contact with inner bottom surface 1*a* of hermetic container 1 at at least one contact part 34 while having elastic force.

A natural frequency of free end part 32 of vibration damping member 30 is brought into substantial conformity with a natural frequency of hermetic container 1, whereby a dynamic vibration absorbing effect is exerted. Meanwhile, contact part 34 of vibration damping member 30 is in elastic contact with inner bottom surface 1*a* of hermetic container 1 while having elastic force, thereby exerting a contact friction damping effect.

In the present exemplary embodiment, as shown in FIGS. 9, 10A, and 10B, vibration damping member 30 is such that fixed part 36 that is fixed to the hermetic container is near a center of a metal plate such as an iron plate, while one end part of the iron plate is defined as free end part 32 with narrow connection part 38 being between fixed part 36 and free end part 32. Meanwhile, contact parts 34*a*, 34*b*, 34*c*, 34*d* provided at another end part of the iron plate are in contact with inner bottom surface 1*a* of hermetic container 1 while having the elastic force with respect to inner bottom surface 1*a*.

As is clear from FIG. 8, vibration damping member 30 is fixed to inner bottom surface 1*a* of hermetic container 1 so as to be entirely immersed in lubricating oil 7 inside hermetic container 1.

A description is provided next of functional effects of vibration damping member 30 configured as described above.

Vibration damping member 30 has fixed part 36 fixed to inner bottom surface 1*a* of hermetic container 1 and free end part 32 that is vibratable. The natural frequency of vibration damping member 30 is in substantial conformity with the natural frequency of hermetic container 1, so that vibration damping member 30 exerts the dynamic vibration absorbing effect. Moreover, contact parts 34*a*, 34*b*, 34*c*, 34*d* that are opposite to free end part 32 are in contact with inner bottom surface 1*a* of hermetic container 1 while having the elastic force, so that energy of micro-vibration of hermetic container 1 is partially converted to thermal energy by contact parts 34*a*, 34*b*, 34*c*, 34*d*. In this way, the contact parts exert the contact friction damping effect.

Thus, the vibration of hermetic container 1 is damped through the dynamic vibration absorbing effect and the contact friction damping effect. As a result, the noise is reduced.

Here, a relatively great vibration damping effect can be obtained from the dynamic vibration absorbing effect of free end part 32. On the other hand, this damping effect is characteristically obtained in a relatively narrow frequency band. Meanwhile, the contact friction damping effect of contact parts 34*a*, 34*b*, 34*c*, 34*d* cannot provide vibration damping as great as a dynamic vibration damping effect of a dynamic vibration absorber; however, a damping effect can characteristically be obtained from contact parts 34*a*, 34*b*, 34*c*, 34*d* in a wider frequency band than that of the dynamic vibration absorber.

Thus, in addition to the great dynamic vibration absorbing effect obtained from free end part 32, the contact friction damping effect in the wide frequency band can be obtained from contact parts 34*a*, 34*b*, 34*c*, 34*d* in vibration damping member 30 of the present exemplary embodiment. Because of this, a greater vibration damping effect in the wide frequency band can be obtained from a synergistic effect as compared with cases where the dynamic vibration absorber or a damping plate is used alone.

FIGS. 11A and 11B show a vibrational state of the hermetic container and a noise condition of the hermetic compressor, respectively. FIG. 11A illustrates the vibrational state of the hermetic container of the hermetic compressor according to the second exemplary embodiment of the present invention. FIG. 11B illustrates the noise condition of the hermetic compressor. In FIGS. 11A and 11B, a vibrational state of a conventional hermetic container without vibration damping member 30 and a noise condition of a conventional hermetic compressor without vibration damping member 30 are indicated by X. The vibrational state of hermetic container 1 of the present exemplary embodiment that is provided with vibration damping member 30 for the dynamic vibration absorbing effect and the contact friction damping effect and the noise condition of the hermetic compressor of the present exemplary embodiment are indicated by Z. It is to be noted that vibration damping member 30 is the one shown in FIGS. 9, 10A and 10B.

As is clear from FIG. 11A, peaks of the vibration of hermetic container 1 are greatly suppressed in Z indicating the vibrational state of the present exemplary embodiment, and as is clear from FIG. 11B, peak values of the noise also are greatly lowered in the wider frequency band in Y indicating the noise condition of the present exemplary embodiment as compared with the case where only the dynamic vibration absorber is used.

Vibration damping member 30 is provided to be positioned in lubricating oil 7 at the bottom of hermetic container 1. A vibration damping effect can thus be obtained from viscous resistance of lubricating oil 7 in addition to the dynamic vibration absorbing effect and the contract friction damping effect that are obtained from vibration damping member 30. This means that the resonance peaks of hermetic container 1 can be lowered accordingly, whereby the noise can be further reduced.

Furthermore, in the hermetic compressor shown as an example in the present exemplary embodiment, electric motor element 2 is driven by an inverter at a plurality of operating frequencies. Accordingly, compressor body 4 performs compression at variable speeds, and it is thus conceivable that the amplitude of hermetic container 1 varies. However, hermetic container 1 of the hermetic compressor is provided with vibration damping member 30. Vibration damping member 30 can reliably exert the dynamic vibration absorbing effect and the contact friction damping effect correspondingly to amplitude variations of hermetic container 1, thereby reducing the noise.

With respect to the vibration of hermetic container 1, the dynamic vibration absorbing effect and the contact friction damping effect are thus obtained at the same time from vibration damping member 30. In this way, the noise can be reduced.

Other conceivable examples of vibration damping member 30 that enhance these effects include those shown in FIGS. 12A, 12B, and 12C. FIG. 12A illustrates another first example of vibration damping member 30 of the hermetic compressor according to the second exemplary embodiment of the present invention. FIG. 12B illustrates another second example of vibration damping member 30 of the hermetic compressor. FIG. 12C illustrates another third example of vibration damping member 30 of the hermetic compressor.

FIG. 12A shows contact part 34 with more contact parts. A greater contact friction damping effect in a wide frequency band can thus be obtained from vibration damping member 30.

FIGS. 12B and 12C each show more free end parts 32 than FIG. 12A, and through torsional vibration, a greater dynamic vibration absorbing effect can be obtained.

Vibration damping member 30 is mounted in a position that is not limited to inner bottom surface 1*a* of hermetic container 1, and similarly to those of the first exemplary embodiment, various mounting positions other than inner bottom surface 1*a* are conceivable. In other words, a suitable mounting position for vibration damping member 30 may be selected according to a vibration mode of hermetic container 1.

Moreover, a shape of vibration damping member 30 may be one of those including the shape shown in FIGS. 10A and 10B and the respective shapes shown in FIGS. 12A, 12B, and 12C, or vibration damping members 30 having these shapes may be combined for use. Using the combination of vibration damping members 30 in the respective examples is effective in further damping the vibration, whereby a noise reducing effect can be exerted.

As described above, vibration damping member 30 of the present exemplary embodiment may be configured such that its part other than free end part 32 includes at least one contact part 34 that is in elastic contact with the surface of hermetic container 1.

In this way, in addition to the dynamic vibration absorbing effect obtained from free end part 32, the contact friction damping effect can be obtained in the wide frequency band from contact part 34. Furthermore, the noise can be reduced reliably and effectively.

Third Exemplary Embodiment

Figure 13:
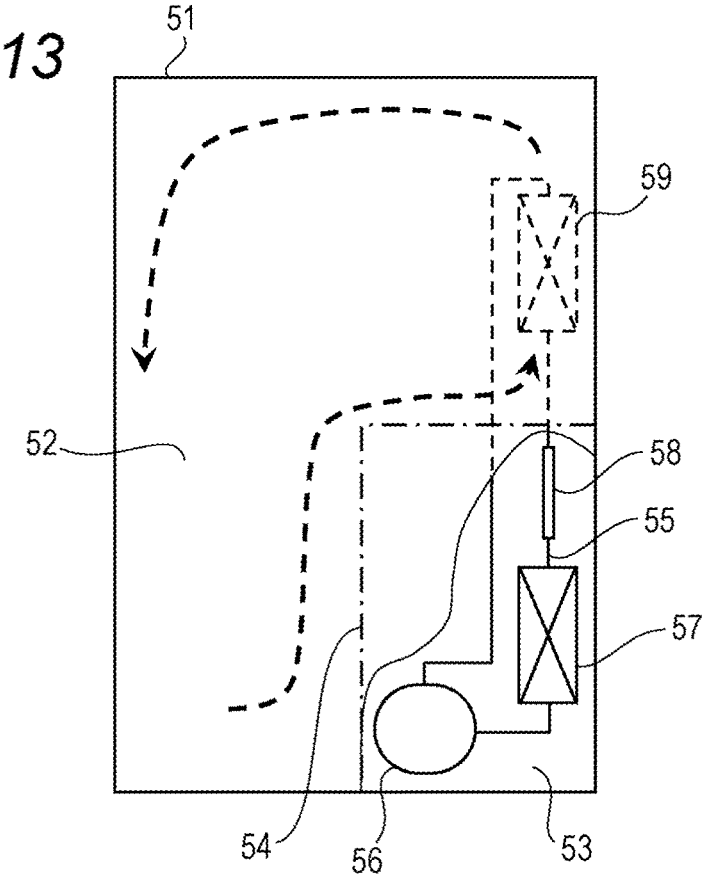
FIG. 13 is a schematic view illustrating a structure of a refrigeration device according to a third exemplary embodiment of the present invention.
Figure 14:
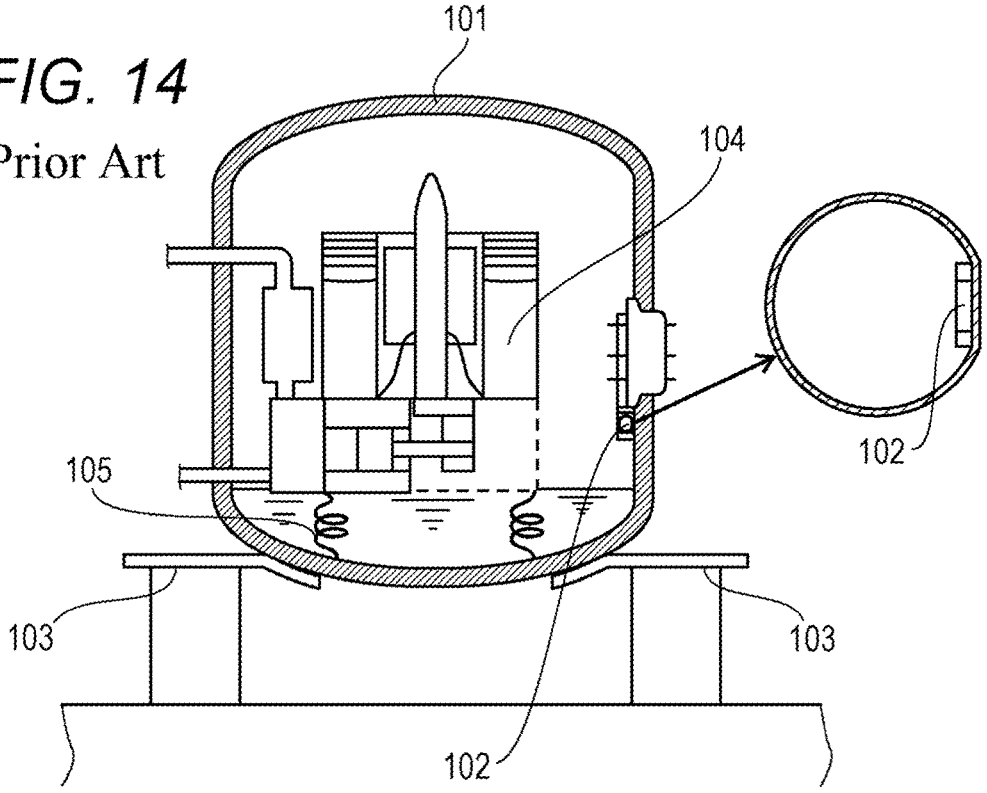
FIG. 14 Prior Art
FIG. 14 illustrates a hermetic compressor described in PTL 1.
Figure 15:
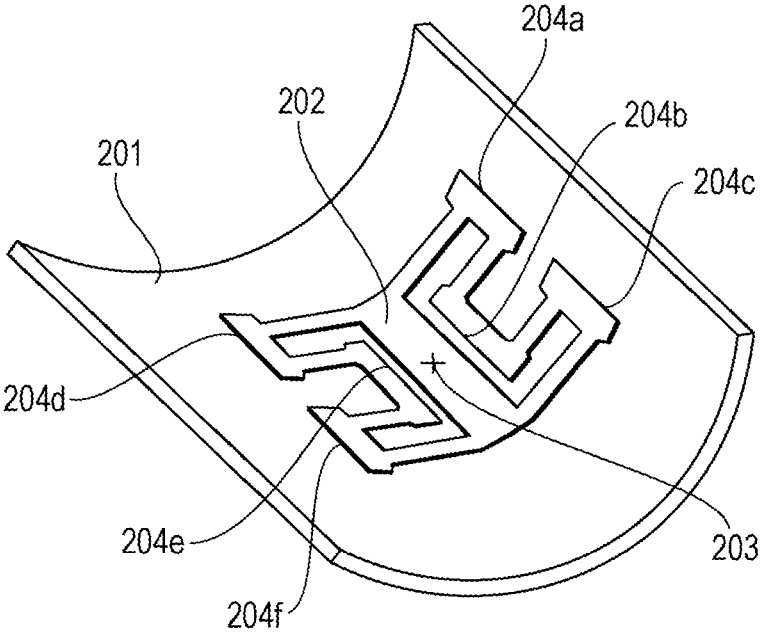
FIG. 15 Prior Art
FIG. 15 illustrates a hermetic container of a hermetic compressor described in PTL 2.

FIG. 13 is a schematic view illustrating a structure of a refrigeration device according to the third exemplary embodiment of the present invention. The refrigeration device is mounted with the hermetic compressor described in the first or second exemplary embodiment in a refrigerant circuit of the refrigeration device. A summary of a basic structure of the refrigeration device is provided.

In FIG. 13, the refrigeration device includes main body 51, partition wall 54, and refrigerant circuit 55. Main body 51 is formed of a thermally insulated housing having an opening provided with a door. Partition wall 54 divides an interior of main body 51 into storage space 52 for articles and machine chamber 53. Refrigerant circuit 55 provides cooling for storage space 52.

Refrigerant circuit 55 has compressor 56, radiator 57, decompression device 58, and heat absorber 59 that are connected in a loop by piping. Compressor 56 is the hermetic compressor described in the first or second exemplary embodiment. Heat absorber 59 is disposed in storage space 52 equipped with a blower (not shown). Cooling heat of heat absorber 59 is agitated by the blower to circulate inside storage space 52 as indicated by an arrow, whereby storage space 52 is cooled.

The refrigeration device described above is provided with, as compressor 56, the hermetic compressor described in the first or second exemplary embodiment, that is, vibration damping member 16 or 30. In this way, the hermetic compressor can be realized to reduce noise of a hermetic container through a dynamic vibration absorbing effect and/or a contact friction damping effect. By being mounted with the hermetic compressor described in the first or second exemplary embodiment, the refrigeration device of the present exemplary embodiment can realize noise reduction.

As described above, the refrigeration device of the present exemplary embodiment includes refrigerant circuit 55 having compressor 56, radiator 57, decompression device 58, and heat absorber 59 that are connected in the loop by piping, and compressor 56 is the hermetic compressor described in the first or second exemplary embodiment.

By being mounted with the hermetic compressor, the refrigeration device can also be reduced in noise.

The exemplary embodiments of the present invention have been described above, and the structures described in the above exemplary embodiments are shown as examples of the present invention. Therefore, it goes without saying that the present invention is susceptible of various modifications within the scope of the present invention that achieves its object and thus includes various hermetic compressors to which structures based on technical ideas of the present invention are applied.

INDUSTRIAL APPLICABILITY

As described above, the present invention enables a dynamic vibration absorbing effect to be exerted reliably and with a reduced parts count and a reduced man-hour, without being affected by other factors such as a state in which a hermetic container is mounted to an appliance or the like, even in cases where a hermetic compressor is of a reciprocating type. Moreover, the present invention can provide a low-cost and highly reliable hermetic compressor capable of noise reduction irrespective of installation variations. Thus, the present invention finds its application that is not limited to household appliances such as an electric refrigerator and an air conditioner but is widely applicable to refrigeration devices such as a commercial showcase and an automatic vending machine.

REFERENCE MARKS IN THE DRAWINGS

1: hermetic container
1*a*: inner bottom surface
2: electric motor element
3: compression element
4: compressor body
5: suspension spring
6: refrigerant gas
7: lubricating oil
8: suction pipe
9: discharge pipe
10: shaft
11: cylinder block
11*a*: compression chamber
12: piston
13: coupler
14: rotor
15: stator
16: vibration damping member
17: bend
18: free end part
18*a*: bend
19: fixed part
20: connection part
21: axis
22: rising piece
22*a*: rising piece
30: vibration damping member
32: free end part
33: bend
34, 34*a*, 34*b*, 34*c*, 34*d*: contact part
36: fixed part
38: connection part
51: main body
52: storage space
53: machine chamber
54: partition wall
55: refrigerant circuit
56: compressor
57: radiator
58: decompression device
59: heat absorber

The invention claimed is:

1. A hermetic compressor comprising a hermetic container and, inside the hermetic container:

an electric motor;

a compression element driven by the electric motor;

a lubricating oil for lubricating the compression element; and a vibration damping member formed of a plate-shaped member having a part fixed to the hermetic container and another part being a free end part, the vibration damping member further comprising a connection part between the part fixed to the hermetic container and the free end part, the connection part being narrower than the part fixed to the hermetic container and the free end part, wherein a widthwise shape of the free end part is offset to one side so that the vibration damping member as a whole is unbalanced in weight with respect to an axis, wherein a natural frequency of the vibration damping member is in conformity with a natural frequency of the hermetic container, and wherein the connection part extends from the fixed part away from a bottom surface of the hermetic container, such that a clearance is provided between the free end part and the bottom surface of the hermetic container and the free end part does not touch the bottom surface of the hermetic container, whereby the free end part can vibrate torsionally.

2. The hermetic compressor according to claim 1, wherein the vibration damping member includes a plurality of the free end parts.

3. The hermetic compressor according to claim 2, wherein the plurality of the free end parts of the vibration damping member have different natural frequencies.

4. The hermetic compressor according to claim 1, wherein a plurality of the vibration damping members are provided.

5. The hermetic compressor according to claim 1, wherein the part of the vibration damping member fixed to the hermetic container is fixed to a part of the hermetic container where amplitude of the natural frequency of the hermetic container is greatest.

6. The hermetic compressor according to claim 1, wherein the vibration damping member is provided inwardly of the hermetic container.

7. The hermetic compressor according to claim 1, wherein the vibration damping member is provided to be positioned in the lubricating oil at a bottom of the hermetic container.

8. The hermetic compressor according to claim 1, wherein the vibration damping member is formed of an iron plate.

9. The hermetic compressor according to claim 1, wherein the vibration damping member further includes, other than the free end part, another part including at least one contact part that is in elastic contact with a surface of the hermetic container.

10. The hermetic compressor according to claim 1, wherein the compression element is of a reciprocating type.

11. The hermetic compressor according to claim 1, wherein driving at a plurality of operating frequencies is caused by an inverter.

12. A refrigeration device comprising a refrigerant circuit including a compressor, a radiator, a decompressor, and a heat absorber that are connected in a loop by piping, wherein the compressor is the hermetic compressor according to claim 1.

* * * * *